US007562771B2

(12) United States Patent
Fontana

(10) Patent No.: US 7,562,771 B2
(45) Date of Patent: Jul. 21, 2009

(54) BOTTLE FOR TWO-COMPONENT EXTEMPORANEOUS PRODUCTS

(75) Inventor: Antonio Fontana, Carpi (IT)

(73) Assignee: Lameplast S.p.A., Rovereto Di Novi (IT)

( * ) Notice: Subject to any disclaimer, the term of this patent is extended or adjusted under 35 U.S.C. 154(b) by 512 days.

(21) Appl. No.: 11/340,434

(22) Filed: Jan. 27, 2006

(65) Prior Publication Data

US 2006/0144727 A1 Jul. 6, 2006

Related U.S. Application Data

(62) Division of application No. 10/399,282, filed as application No. PCT/EP01/12300 on Oct. 24, 2001, now Pat. No. 7,025,200.

(30) Foreign Application Priority Data

Oct. 25, 2000 (IT) ..... MO2000A0233

(51) Int. Cl.
*B65D 25/08* (2006.01)

(52) U.S. Cl. ..... 206/222; 206/568; 215/6; 215/DIG. 8

(58) Field of Classification Search ..... 206/222, 206/253, 254, 532, 219, 568; 222/145.5, 222/80; 215/6, DIG. 8
See application file for complete search history.

(56) References Cited

U.S. PATENT DOCUMENTS

| | | | | | |
|---|---|---|---|---|---|
| 1,419,580 | A | * | 6/1922 | Molinari | 141/381 |
| 3,156,369 | A | * | 11/1964 | Bowes et al. | 206/222 |
| 3,603,469 | A | * | 9/1971 | Magni | 206/222 |
| 3,968,872 | A | * | 7/1976 | Cavazza | 206/222 |
| 4,416,381 | A | * | 11/1983 | Swartwout | 215/228 |
| 5,029,718 | A | * | 7/1991 | Rizzardi | 215/254 |
| 5,038,951 | A | * | 8/1991 | Rizzardi | 215/256 |
| 5,543,097 | A | | 8/1996 | Fang | |
| 5,662,249 | A | * | 9/1997 | Grosse | 222/461 |
| 5,884,759 | A | * | 3/1999 | Gueret | 206/222 |
| 6,148,996 | A | * | 11/2000 | Morini | 206/222 |
| 6,435,341 | B1 | | 8/2002 | Nobio | |

FOREIGN PATENT DOCUMENTS

| | | |
|---|---|---|
| EP | 0 133 461 | 2/1985 |

* cited by examiner

*Primary Examiner*—Luan K Bui
*Assistant Examiner*—Chun Cheung
(74) *Attorney, Agent, or Firm*—Browdy and Neimark, P.L.L.C.

(57) ABSTRACT

A bottle for two-component extemporaneous products, of the type that comprises: a container for a first component, which is provided with an upper mouth; a reservoir for containing a second component, which is inserted substantially coaxially in the mouth, is open upward and has a bottom constituted by a diaphragm; a perforator, which can be inserted in the reservoir and is adapted to pierce the diaphragm in order to mix the two components; and a removable cap for closing the container in an upward region; the cap comprises a lower annular portion that is fixed to the container and an upper cylindrical portion that cooperates with the perforator and is rigidly coupled to the annular portion at an intermediate weakened region suitable to act as sealing means, a downward pressure on the cylindrical portion being adapted to disengage it from the annular portion and to make the perforator slide in the reservoir in order to pierce the underlying diaphragm.

7 Claims, 5 Drawing Sheets

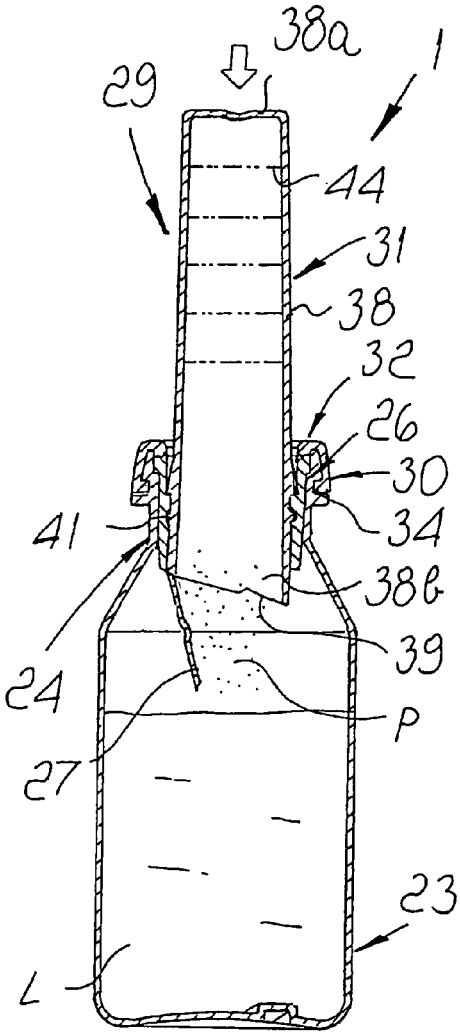
Fig. 9
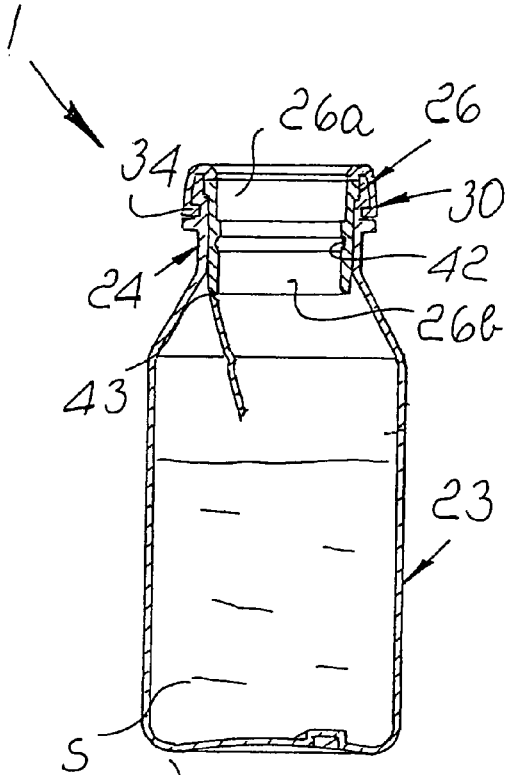
Fig. 10
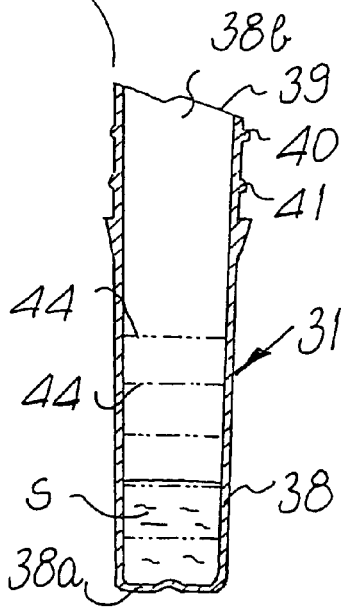

BOTTLE FOR TWO-COMPONENT EXTEMPORANEOUS PRODUCTS

This Application is a DIV of Ser. No. 10/399,282 filed on Apr. 16, 2003, now U.S. Pat. No. 7,025,200, which is a 371 of PCT/EP01/12300 filed on Oct. 24, 2001.

BACKGROUND OF THE INVENTION

The present invention relates to a bottle for two-component extemporaneous products.

In the pharmaceutical sector there are products composed of two substances that are mixed together just before administering the products; the individual separated substances in fact remain stable longer than the product obtained from them.

One of the two substances is generally in powder or granular form and the other is in liquid form; the former dissolves or disperses in the latter.

Single- or multiple-dose bottles for two-component extemporaneous products are known which comprise a container for one of the two components that is provided with a mouth in which a reservoir of the other component is inserted hermetically; the reservoir is open in an upward region and its bottom is constituted by a membrane-like diaphragm that separates the reservoir from the container.

Known bottles further comprise a closure cap that is fixed to the container and is provided with a perforator that is internal and coaxial thereto and is partially inserted hermetically in the reservoir.

The cap is usually constituted by three portions: a lower annular portion, which is fixed to the outer walls of the mouth of the container; an upper portion, which is constituted by a hood that is coaxial to the perforator; and an intermediate portion, which is constituted by sealing means such as a removable annular band that is connected to the lower and upper portions along respective fracture lines and is provided with a grip tab; the elimination of such band by tearing disengages the upper portion from the lower one.

In order to prepare the product to be administered, it is necessary to tear off and eliminate the band and apply pressure to the head of the hood; the hood moves towards the container, while the perforator descends into the reservoir and tears its diaphragm-like bottom.

In this manner, the component contained in the reservoir is poured into the container, where it mixes with the other component in order to prepare the product to be administered.

As an alternative, the cap is partially screwed onto the outer walls of the mouth of the container and is provided with sealing means such as an annular band; in order to prepare the product, it is necessary to eliminate the sealing means and screw the cap more tightly in order to make the perforator descend into the reservoir until it tears the diaphragm-like bottom.

In single-dose bottles, the perforator is fixed to the cap; the elimination of the cap in order to open the bottle accordingly entails extracting the perforator from the reservoir.

In this last case, however, the torn diaphragm tends to return to a substantially horizontal position, thus hindering the complete dispensing of the prepared product.

Known types of bottle, therefore, are not devoid of drawbacks, including the fact that they make it very time-consuming and difficult to prepare the two-component product to be administered and they entail significant consumption and waste of materials.

Preparation of the product in fact entails a first operation for eliminating the sealing means (the annular band) and a second operation for moving the hood towards the container, by pushing or screwing it on, so that the perforator tears the diaphragm.

The sealing means to be eliminated entail consumption of material and constitute waste material that is difficult to recover.

Another disadvantage of known types of single-dose bottle is constituted by the fact that they do not allow complete dispensing of the product prepared in them, since after the perforator is eliminated together with the cap the diaphragm tends to close the reservoir again.

SUMMARY OF THE INVENTION

The aim of the present invention is to eliminate the above noted drawbacks of known bottles by providing a bottle for two-component extemporaneous products that allows the preparation of the product to be administered to become quick, simple and manually easy and allows to contain the consumption and waste of material.

An object of the present invention is to allow full dispensing of the products prepared in individual administration doses, thus ensuring that they are taken fully by their users.

Within this aim, another object of the present invention is to provide a structure that is simple, relatively easy to provide in practice, safe in use, effective in operation, and relatively low in cost.

This aim and these and other objects which will become better apparent hereinafter are achieved by the present bottle for two-component extemporaneous products, of the type that comprises: a container for a first component, which is provided with an upper mouth; a reservoir for containing a second component, which is inserted substantially coaxially in said mouth, is open upward and has a bottom constituted by a diaphragm; a perforator, which can be inserted in said reservoir and is suitable to pierce said diaphragm in order to mix the two components; and a removable cap for closing the container in an upward region, characterized in that said cap comprises a lower annular portion that is fixed to said container and an upper cylindrical portion that is suitable to cooperate with said perforator and is rigidly coupled to said annular portion at an intermediate weakened region suitable to act as sealing means, a downward pressure on said cylindrical portion being suitable to disengage it from said annular portion and to make said perforator slide in said reservoir in order to pierce the underlying diaphragm.

BRIEF DESCRIPTION OF THE DRAWINGS

Further characteristics and advantages of the present invention will become better apparent from the detailed description of a preferred but not exclusive embodiment of a bottle for two-component extemporaneous products, illustrated only by way of non-limitative example in the accompanying drawings, wherein:

FIG. 9 is a view of the bottle of FIG. 8 after piercing the diaphragm to prepare the product to be administered;

FIG. 10 is a view of the bottle of FIG. 9, open in order to dispense the prepared product;

DESCRIPTION OF THE PREFERRED EMBODIMENTS

Figure 1:
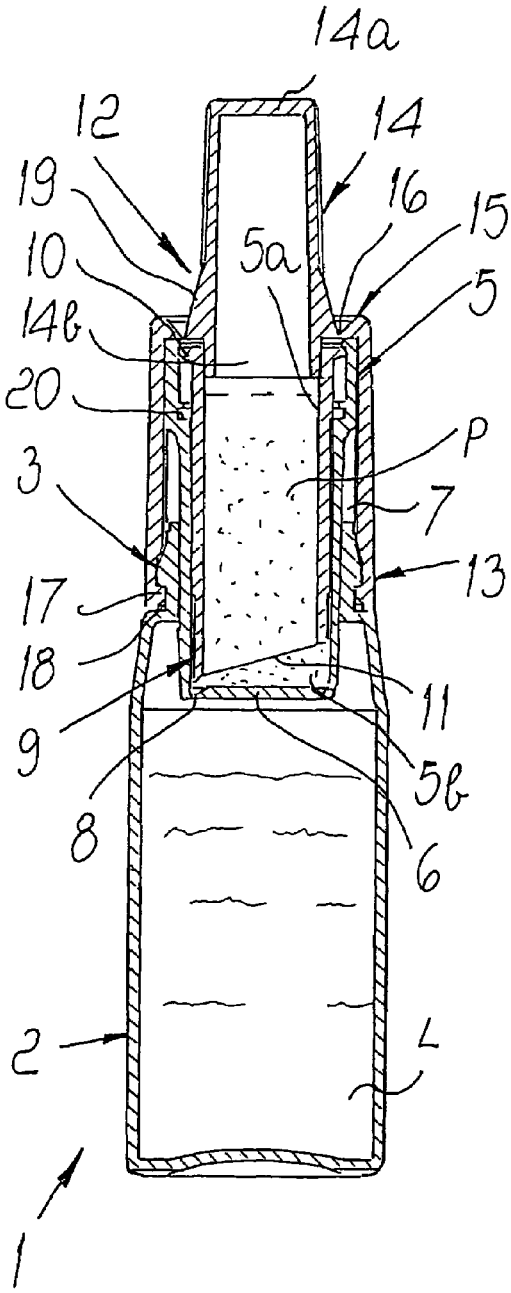
FIG. 1 is a longitudinal sectional view of a bottle according to the invention before the preparation of the product to be administered.
Figure 2:
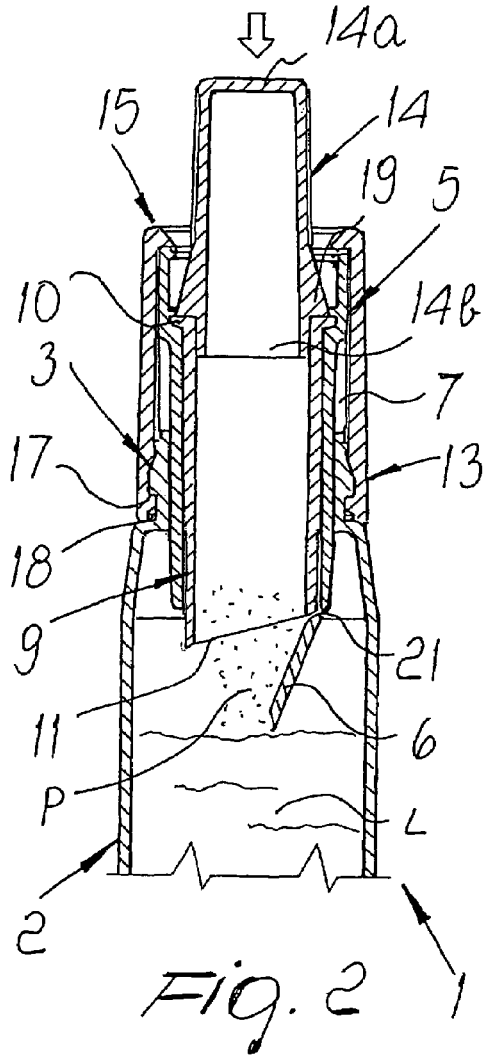
FIG. 2 is an enlarged-scale view of the upper portion of the bottle of FIG. 1 after piercing the diaphragm to prepare the product to be administered.
Figure 3:
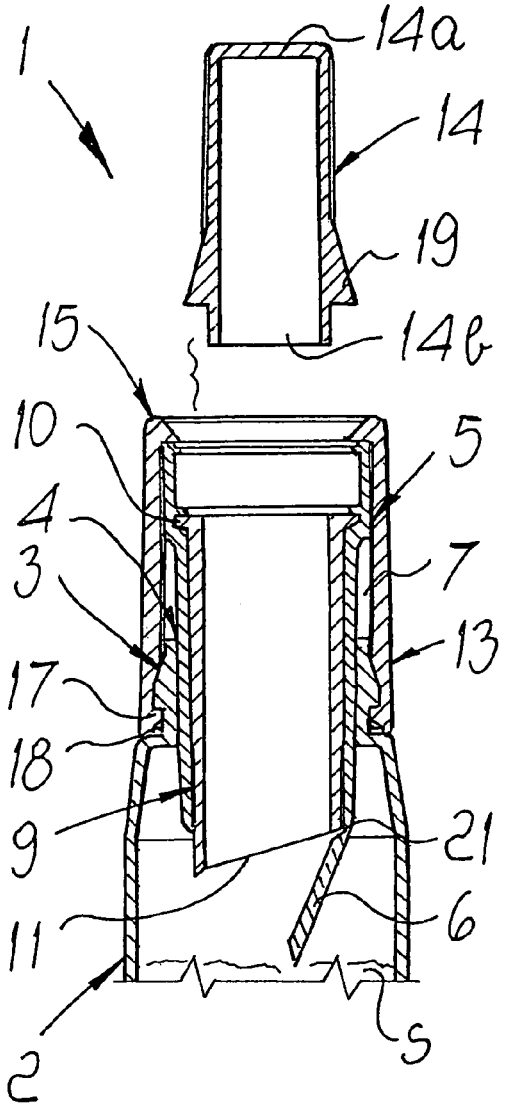
FIG. 3 is a view of the upper portion of the bottle of FIG. 2, open in order to dispense the prepared product.
Figure 4:
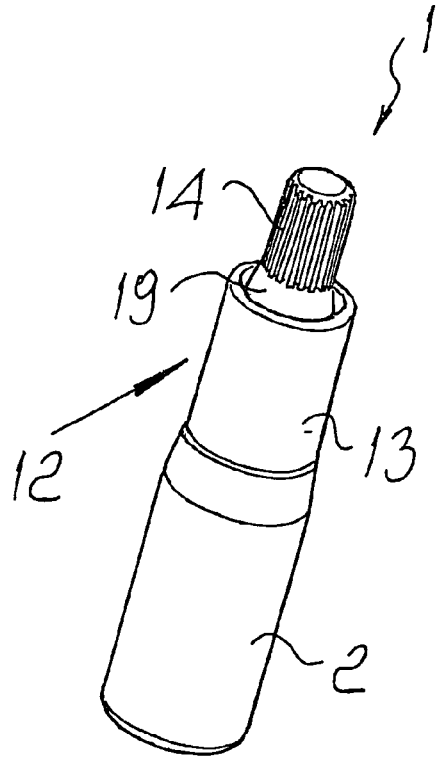
FIG. 4 is a perspective view of the bottle of FIG. 1.
Figure 5:
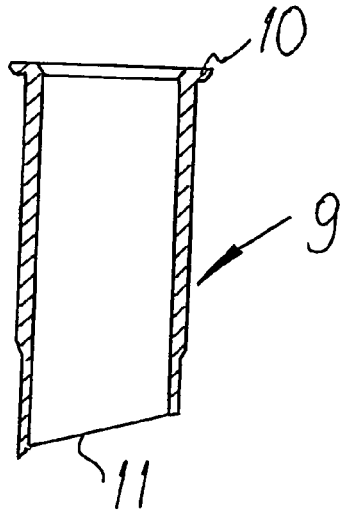
FIG. 5 is a longitudinal sectional view of the perforator of the bottle of FIG. 1.
Figure 6:
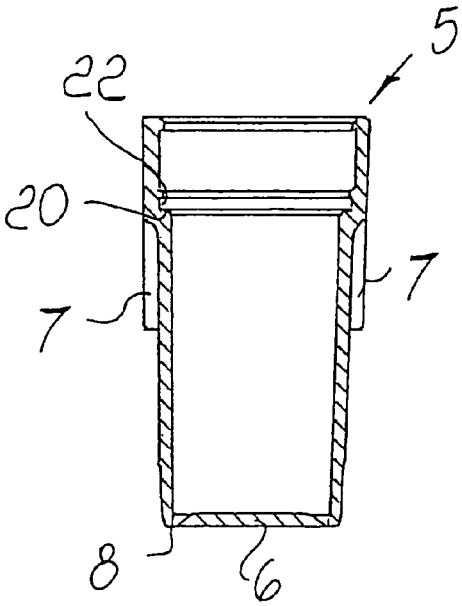
FIG. 6 is a longitudinal sectional view of the reservoir of the bottle of FIG. 1.
Figure 7:
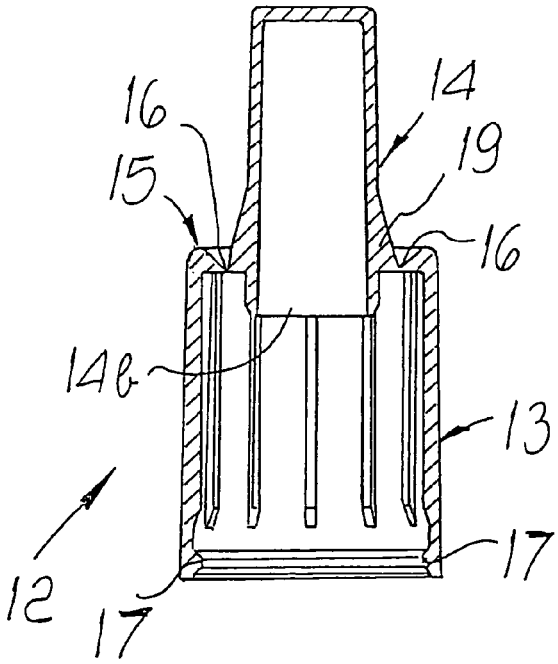
FIG. 7 is a longitudinal sectional view of the closure cap of the bottle of FIG. 1.

With reference to the figures, the reference numeral 1 generally designates a bottle for two-component extemporaneous products such as, for example, pharmaceutical products and drugs composed of two substances, generally one in powder form P and one in liquid form L, which are mixed at the time of their first administration in order to produce a final product S.

In the embodiment shown in FIGS. 1 to 7, the bottle 1 comprises a container 2 that is filled with a preset amount of liquid L and is provided, in an upward region, with a neck 3 in which a mouth 4 is formed.

A reservoir 5, which contains a preset amount of powder P, is inserted hermetically in the mouth 4; the reservoir 5 is shaped like a hollow cylinder and is coaxial to the mouth 4, has an open upper face 5*a* and a lower face 5*b* that is closed by a diaphragm 6 that separates it and isolates it from the container 2, and is provided externally with longitudinal ridges 7 for resting on the upper rim of the neck 3.

The diaphragm 6 is like a membrane that is connected peripherally to the edge of the lower face 5*b* along a preset tear line 8.

A perforator 9, such as a tubular body, is inserted coaxially and slidingly in the reservoir 5 and has, in an upward region, an abutment collar 10 and, in a downward region, a beveled piercing profile 11 that is suitable to tear the diaphragm 6 at the line 8.

The bottle 1 further comprises a removable cap 12 that closes in an upward region the container 1 and is constituted by a lower annular portion 13, which externally surrounds the neck 3 to which it is fixed, and by an upper cylindrical portion 14, which is suitable to cooperate with the perforator 9; the inside diameter of the annular portion 13 is greater than the outside diameter of the cylindrical portion 14.

The two portions 13 and 14 are arranged coaxially to the reservoir 5 and, by having different diameters, form a horizontal annular base 15 at which they are mutually coupled along a weakened intermediate region constituted for example by a prefracture line 16 that is suitable to act as a means for sealing the bottle.

The annular portion 13 is fixed to the neck 3 by way of interlocking coupling means that are constituted by an annular tooth 17 that is provided so as to protrude on the inner lateral wall of the annular portion 13 and enters by interlocking in a corresponding recess 18 formed at the base of the outer side wall of the neck 3.

The cylindrical portion 14 is shaped like a hollow cylindrical body, whose upper end 14*a* is closed and whose lower end 14*b* is open and protrudes inside the annular portion 13.

A frustum-shaped circumferential expansion 19 is formed on the outer lateral wall of the cylindrical portion 14; its smaller end face is directed towards the upper end 14*a* and its larger end face is coupled to the annular base 15 at the prefracture line 16.

A downward axial pressure on the cylindrical portion 14 is sufficient to uncouple it from the annular portion 13 by breaking the sealing means formed by the line 16.

FIG. 1 illustrates a bottle 1 as packaged before the preparation of the product S, in which the annular portion 13 is fixed to the neck 3 and is still rigidly coupled to the cylindrical portion 14, whose lower end 14*b* is partially inserted in the top of the perforator 9.

By applying a downward pressure to the cylindrical portion 14 (FIG. 2), the sealing means formed by the line 16 are broken and the cylindrical portion 14 is uncoupled from the annular one 13, which remains anchored to the neck 3.

By continuing to apply the pressure, the uncoupled cylindrical portion 14 slides inside the annular portion 13 and the lower end 14*b* penetrates further into the perforator 9 until the larger end face of the expansion 19 abuts against the collar 10.

Then the perforator 9, pushed by the cylindrical portion 14, slides inside the reservoir 5, descending and piercing the diaphragm 6 along the line 8.

The sliding stroke of the perforator 9 is determined by a stroke limiting surface 20, which is formed on the inner wall of the reservoir 5 and against which the collar 10 abuts; said stroke is such as to tear the diaphragm 6 along a preset circular arc, so that the tom diaphragm 6 remains attached to the reservoir 5 at at least one point 21.

The lower end face 5*b* of the reservoir is thus opened and the powder P is poured by gravity into the container 2, where it mixes with the liquid L; the product S is ready for administration.

Advantageously, the reservoir 5 is internally provided with a seat 22 for the interlocking insertion of the collar 10, which is formed at the stroke limiting surface 20; once the diaphragm 6 has been torn, the collar 10 interlocks in the seat 22, stably anchoring the perforator 9 to the reservoir 5.

The bottle 1 is opened (FIG. 3) by pulling out and removing the cylindrical portion 14: the perforator 9 remains fixed to the reservoir 5 and thus keeps the torn diaphragm 6 lowered, preventing it from closing the lower flat surface 5*b* and hindering the dispensing of the product S.

The cylindrical portion 14 can be used to reclose the open bottle 1, since its lower end 14*b* can be inserted hermetically in the perforator 9.

FIGS. 8 to 13 illustrate an alternative embodiment of the bottle 1.

In such alternative embodiment, the bottle 1 comprises a container 23 for the liquid L that is provided, in an upward region, with a neck 24 in which a mouth 25 is formed.

A reservoir 26, which contains the powder P, is inserted hermetically in the mouth 25; the reservoir 26 is shaped like a hollow cylinder whose upper end face 26*a* is open and whose lower end face 26*b* is closed by a diaphragm 27 that isolates it and separates it from the container 23.

The diaphragm 27 is of the membrane type and is connected to the edge of the lower end face 26*b* along a preset fracture line 28.

The bottle 1 further comprises a removable cap 29, which closes in an upward region the container 23 and is constituted by a lower annular portion 30, which externally surrounds the neck 24 to which it is fixed, and by an upper cylindrical portion 31.

The two portions 30 and 31 are coaxial to the reservoir 26 and are mutually coupled at a weakened intermediate region 32 constituted by a prefracture line 33.

The annular portion 30 is fixed to the neck 24 by way of interlocking coupling means constituted by an annular tooth 34 that is formed so as to protrude on its inner lateral surface and interlocks in a corresponding recess 35 formed in the outer side wall of the neck 24.

The annular base 32 is internally provided with a vertical circumferential tooth 36 that engages a corresponding notch 37 formed in the upper rim of the reservoir 26.

The cylindrical portion 31 is constituted by an internally hollow elongated cylindrical body 38, in which the upper end 38*a* is closed and the lower end 38*b* is open and protrudes into the annular portion 30 and directly enters the reservoir 26 coaxially and slidingly; the edge of the lower end 38*b* is constituted by a beveled piercing profile 39.

The lower end 38*b* thus acts as a perforator; in this embodiment of the bottle 1, therefore, the upper cylindrical portion of the closure cap and the perforator of the diaphragm are provided monolithically as the body 38.

Conveniently, on the outer side wall of the lower end 38*b* there is a lower annular step 40 and an upper annular step 41, while the reservoir 26 is internally provided with a complementary annular seat 42.

Figure 8:
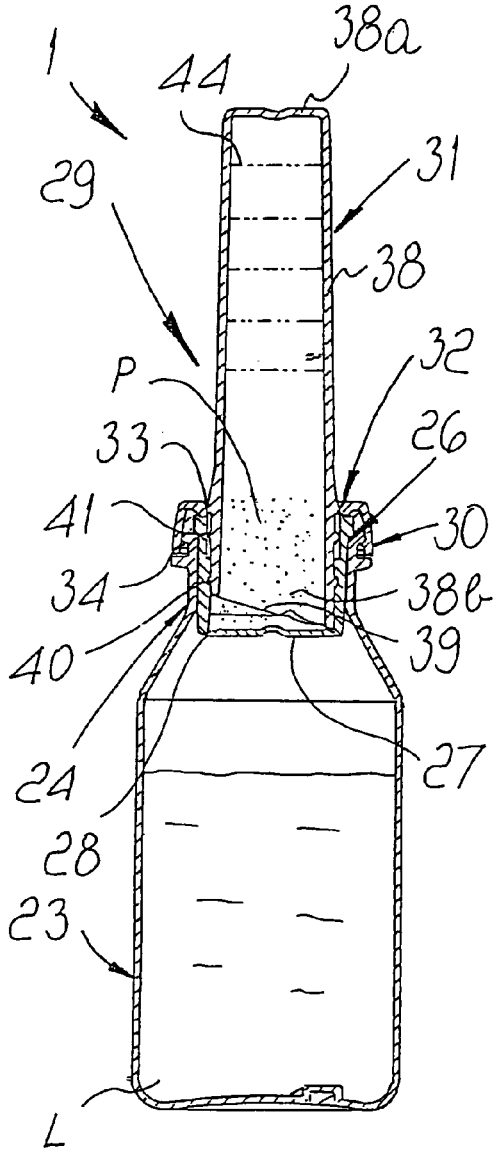
FIG. 8 is a longitudinal sectional view of a further embodiment of the bottle according to the invention before the preparation of the product to be administered.
Figure 11:
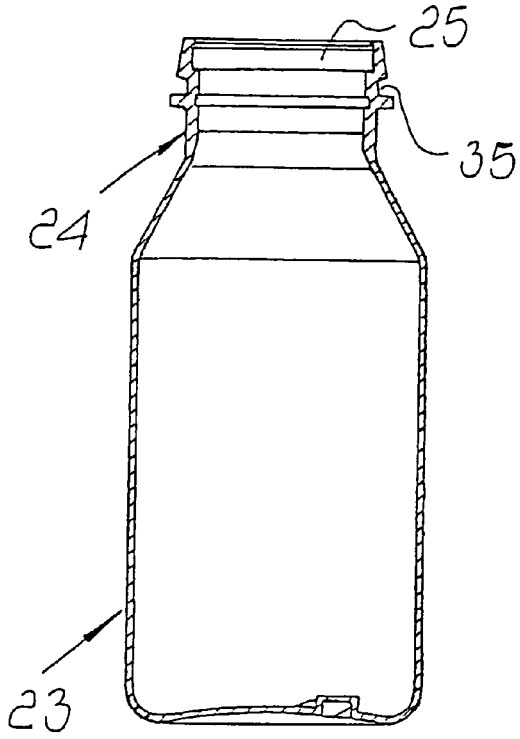
FIG. 11 is a longitudinal sectional view of the container of the bottle of FIG. 8.
Figure 12:
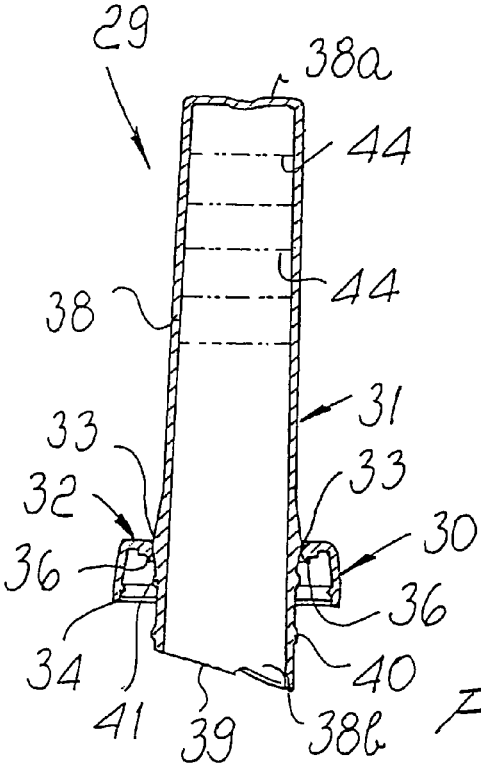
FIG. 12 is a longitudinal sectional view of the closure cap of the bottle of FIG. 8.
Figure 13:
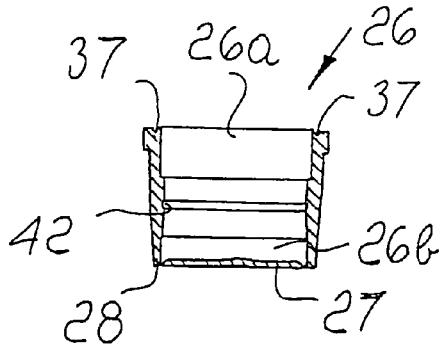
FIG. 13 is a longitudinal sectional view of the reservoir of the bottle of FIG. 8.

FIG. 8 illustrates the bottle 1 in the alternative embodiment, as packaged before preparing the product S.

The annular portion 30 is fixed to the neck 24 and is rigidly coupled to the body 38 at the line 33; the lower piercing end 38*b* of the body 38 is slidingly inserted in the reservoir 26 and the lower step 40 is engaged in the annular seat 42.

By applying a downward axial pressure to the top of the body 38, the sealing means formed by the line 33 are broken and the body 38 is disengaged from the annular portion 30, which remains anchored to the neck 24.

By continuing to apply the pressure (FIG. 9), the body 38 slides within the reservoir 26 and the profile 39 tears the diaphragm 27 at the line 28.

The profile 39 is such as to tear the diaphragm 27 along a circular arc, so that once it has been torn it remains attached to the rim of the lower end face 26*b* in at least one point 43.

The sliding of the body 38 stops when the upper step 41 engages the annular seat 42.

The lower end face 26*b* of the reservoir is thus open and the powder P pours by gravity into the container 23, where it mixes with the liquid L.

The bottle 1 (FIG. 10) is opened by pulling out and removing the body 38 from the reservoir 26.

Conveniently, the body 38 can be inserted again in the reservoir 26 and removed from it to subsequently close and open the bottle 1 and can be used as a measurer for the product S, since it is provided with a plurality of reference notches 44 for the level of the product S.

In practice it has been found that the described invention achieves the proposed aim and objects.

The invention thus conceived is susceptible of numerous modifications and variations, all of which are within the scope of the appended claims.

All the details may further be replaced with other technically equivalent ones.

In practice, the materials employed, as well as the shapes and the dimensions, may be any according to requirements without thereby abandoning the scope of the protection of the appended claims.

The disclosures in Italian Patent Application No. MO2000A000233 from which this application claims priority are incorporated herein by reference.

What is claimed is:

1. A bottle for two-component extemporaneous products, of the type that comprises: a container for a first component, which is provided with an upper mouth; a reservoir for containing a second component, which is inserted substantially coaxially in said mouth, is open upward and has a bottom constituted by a diaphragm; a perforator, which can be inserted in said reservoir and is suitable to pierce said diaphragm in order to mix the two components; and a removable cap for closing the container in an upward region, wherein:

said cap comprises a lower annular portion that is locked to said container and an upper cylindrical portion that is suitable to cooperate with said perforator and is rigidly coupled to said annular portion at an intermediate weakened region suitable to act as sealing means, a downward pressure on said cylindrical portion being suitable to disengage it from said annular portion and to make said perforator slide in said reservoir in order to pierce the underlying diaphragm;

said cylindrical portion and said perforator are formed monolithically in a single piece; and said single piece is constituted by an elongated hollow cylindrical body whose upper end is closed and whose lower end is open and protrudes into said annular portion so as to enter said reservoir and has a lower rim constituted by a piercing profile, downward pressure being suitable to disengage said single piece from the annular portion and make it slide inside the reservoir in order to pierce the diaphragm.

2. The bottle according to claim 1, wherein said annular portion comprises means for interlocking coupling with outer walls of said container proximate to said mouth.

3. The bottle according to claim 1, wherein said single piece disengaged from the annular portion can be removed and reinserted in said reservoir in order to subsequently open and close the container.

4. The bottle according to claim 3, wherein said single piece is provided with a plurality of reference notches for the level of product, the removed single piece being suitable to act as a measurer for the prepared product.

5. A bottle for two-component extemporaneous products, of the type that comprises: a container for a first component, which is provided with an upper mouth; a reservoir for containing a second component, which is inserted substantially coaxially in said mouth, is open upward and has a bottom constituted by a diaphragm; a perforator, which can be inserted in said reservoir and is suitable to pierce said diaphragm in order to mix the two components; and a removable cap for closing the container in an upward region, wherein said cap comprises a lower annular portion that is coupled to said container and an upper cylindrical portion that is suitable to cooperate with said perforator and is rigidly coupled to said annular portion at an intermediate weakened region suitable to act as sealing means, a downward pressure on said cylindrical portion being suitable to disengage it from said annular portion and to make said perforator slide in said reservoir in order to pierce the underlying diaphragm;

wherein said cylindrical portion is constituted by a hollow cylindrical body, in which the upper end is closed and the lower end is open and protrudes into said annular portion; and wherein said perforator is constituted by a tubular body that is provided with a lower piercing profile and with an upper abutment collar, and wherein said lower end of said cylindrical portion is partially inserted in said body and is provided with an external circumferential expansion that is rigidly coupled to said annular portion at said weakened intermediate region constituted by a circumferential perfracture line, downward pressure being suitable to break said line and cause downward movement, in succession, of said cylindrical portion until said expansion abuts against said collar and of said perforator until said collar abuts against a corresponding stroke limiting surface formed inside the underlying reservoir.

6. A bottle for two-component extemporaneous products, of the type that comprises: a container for a first component, which is provided with an upper mouth; a reservoir for containing a second component, which is inserted substantially coaxially in said mouth, is open upward and has a bottom constituted by a diaphragm; a perforator, which can be inserted in said reservoir and is suitable to pierce said diaphragm in order to mix the two components; and a removable cap for closing the container in an upward region, which comprises a lower annular portion that is fixed to said container and an upper cylindrical portion that is suitable to cooperate with said perforator, said cylindrical portion and said perforator being formed monolithically in a single piece which is rigidly coupled to said annular portion at an intermediate weakened region suitable to act as sealing means, a downward pressure on said single piece being suitable to disengage it from said annular portion and to make said single piece slide in said reservoir in order to pierce the underlying diaphragm, and wherein said single piece disengaged from the annular portion can be removed and reinserted in said reservoir in order to subsequently open and close the container.

7. The bottle according to claim 6, wherein said single piece is provided with a plurality of reference notches for the level of product, the removed single piece being suitable to act as a measurer for the prepared product.

* * * * *